US007444947B2

(12) United States Patent
Katayama

(10) Patent No.: US 7,444,947 B2
(45) Date of Patent: Nov. 4, 2008

(54) METHOD FOR FEEDING A MIXTURE COMPRISING A BURNABLE SOLID AND WATER

(76) Inventor: Yukuo Katayama, 21-25 Daikyo-cho, Shinjuku-ku, Tokyo 160-0015 (JP)

( * ) Notice: Subject to any disclaimer, the term of this patent is extended or adjusted under 35 U.S.C. 154(b) by 56 days.

(21) Appl. No.: 10/538,807

(22) PCT Filed: Dec. 11, 2003

(86) PCT No.: PCT/JP03/15872

§ 371 (c)(1),
(2), (4) Date: Jun. 13, 2005

(87) PCT Pub. No.: WO2004/055436

PCT Pub. Date: Jul. 1, 2004

(65) Prior Publication Data

US 2006/0105278 A1 May 18, 2006

(30) Foreign Application Priority Data

Dec. 13, 2002 (JP) ..... 2002-362202

(51) Int. Cl.
*F23B 7/00* (2006.01)

(52) U.S. Cl. ..... 110/341; 110/348

(58) Field of Classification Search ..... 110/348, 110/263, 201, 218, 341, 342; 431/2, 3; 48/DIG. 7
See application file for complete search history.

(56) References Cited

U.S. PATENT DOCUMENTS 3,476,494 A * 11/1969 Straight, Jr. et al. ..... 431/353

(Continued)

FOREIGN PATENT DOCUMENTS

EP 1 209 214 A2 5/2002

(Continued)

*Primary Examiner*—Kenneth B Rinehart
(74) *Attorney, Agent, or Firm*—Oliff & Berridge, PLC

(57) ABSTRACT

The present invention is a method for feeding a mixture comprising a burnable solid and water to a combustion furnace or gasification reactor, comprising heating the mixture with a heater to convert at least a part of the water in the mixture into a form of steam and feeding the whole mixture to a combustion furnace or gasification reactor, wherein the whole mixture is transferred between an inlet of the heater and the combustion furnace or gasification reactor by a pump, characterized in that a discharge pressure at the pump is higher than an inner pressure in the combustion furnace or gasification reactor at least by 1.5 MPa and not higher than 22.12 MPa, and that a flow rate of said mixture with at least a part of the water being in a form of steam is from 6 to 50 m/s in a pipe in the heater and in a pipe between an outlet of the heater and an inlet of the combustion furnace or gasification reactor. The present invention provides a method for feeding a mixture of a burnable solid and water to a combustion furnace or gasification reactor, comprising heating the mixture with a heater to convert at least a part of the water in the mixture into a form of steam and feeding the whole mixture to a combustion furnace or gasification reactor, wherein almost no abrasion is caused in the pipes where the mixture flows and a stable feed of the mixture to a combustion furnace of a gasification reactor is attained without sedimentation of the burnable solid.

24 Claims, 4 Drawing Sheets

U.S. PATENT DOCUMENTS 4,153,427 A * 5/1979 Bissett et al. ..... 48/86 R

FOREIGN PATENT DOCUMENTS

JP A 62-252497 11/1987

JP A 4-217705 8/1992

JP A 2002-155288 5/2002

* cited by examiner

METHOD FOR FEEDING A MIXTURE COMPRISING A BURNABLE SOLID AND WATER

CROSS REFERENCES

This application claims the benefits of International Patent Application WO2004/055436 filed on Dec. 11, 2003 and Japanese Patent Application 2002-362202 filed on Dec. 13, 2002, the contents of which are thereby incorporated by reference.

FIELD OF THE INVENTION

The present invention relates to a method for feeding a mixture comprising a burnable solid and water to a combustion furnace or gasification reactor, and more particularly, to a method for feeding the aforementioned mixture to a combustion furnace or gasification reactor, wherein at least a part of the water in the mixture is converted into a form of steam.

BACKGROUND OF THE INVENTION

As a means to feed a water slurry comprising a burnable solid, such as pulverized coal or a cellulosic solid waste, to a combustion furnace or gasification reactor, use was made of methods where a slurry is sprayed directly into a combustion furnace or gasification reactor with an aid of a high pressure gas, such as steam or air. The slurry contains water in an amount of from 27 to 80 weight %, relative to the weight of the slurry, and the water vaporizes in a combustion furnace or gasification reactor. In a slurry of pulverized coal and water, the water content is from 27 to 50%, relative to the weight of the slurry. A mixture containing a cellulosic solid waste and water sometimes fails to form a slurry, for instance, when the water content is at most 50% relative to the weight of the mixture. Accordingly, some kinds of slurry require a water content of 50% or more, particularly of from 70 to 80%, relative to the weight of the slurry, depending on the kind of cellulosic solid waste. Therefore, a part of the energy generated in partial combustion of a burnable solid is consumed as latent heat for vaporization of the water, which lowers a temperature in the furnace, resulting in an increase in unburned carbon. In the gasification reactor, fused coal ash deposits because of the lowered temperature in the gasification reactor. This causes troubles such as clog in a withdrawing line for fused ash. In order to prevent the troubles, the temperature in the furnace must be prevented from lowering. Accordingly a larger amount of oxygen than a theoretical amount calculated from an elemental composition of the coal is fed to a gasification reactor in the aforesaid conventional method.

In order to use pulverized coal containing ash of a high fusing temperature, especially in gasification, the inner temperature of a gasification reactor must be maintained at a relatively high temperature. Accordingly, it is difficult in the conventional methods to use coal containing ash of a high fusing temperature. When such a coal containing ash of a high fusing temperature is unavoidably used, an expensive melting point depressant should be used. In addition, a larger amount of oxygen is required to somewhat raise the inner temperature of the gasification reactor whereby melting of the coal ash in the gasification reactor is promoted so as to facilitate removal of the coal ash at a bottom of the gasification reactor and thereby to put the gasification plant in smooth operations. A gasification efficiency of the conventional methods is low due to these factors.

A method of coal gasification by feeding coal and water to a gasification reactor is known, where at least a part of water is fed in a form of steam to the gasification reactor (see Japanese Patent Laid-open No. 2002-155288). According to the method, coal is fed with an aid of steam to a gasification reactor. Therefore, water contained in the mixture of coal and water, preferably the entire amount thereof, is vaporized into steam before being fed to the gasification reactor and, therefore, the above-described drawbacks can be solved.

In the above method, a mixture of solid-liquid system is converted into a mixture of gas-solid or gas-liquid-solid system and fed to a reactor. As equipment by which a slurry of solid-liquid system is fed to a heat exchanger consecutively, heated, converted into a gas-solid system or gas-liquid-solid system, which is then fed to vaporization equipment to recover water, Cracksystem™ is commercially available from Hosokawa Micron Co., Ltd. However, the solvent vaporizes at once in the heat exchanger in this equipment, so that a flow rate of the gas-solid system at an outlet of the heat exchanger exceeds the sonic speed. Accordingly, if the equipment is used for a burnable solid such as coal, heavy abrasion will take place.

In 1979, patent application was filed by the Department of Energy, United States, in which a coal water mixture, CWM, is heated and separated into gas and solid in a flash dryer vessel, and then pulverized coal is fed to a gasification reactor (see U.S. Pat. No. 4,153,427). However, the pulverized coal obtained in the gas-solid separation is not completely dried and, therefore, coagulates, so that a continuous feeding to the gasification reactor is difficult. Accordingly the method has not been put to a practical application.

SUMMARY OF THE INVENTION

The present invention provides a method for feeding a mixture comprising a burnable solid and water to a combustion furnace or gasification reactor wherein at least a part of the water in the mixture is converted into a form of steam, and wherein almost no abrasion takes place in piping and stable feeding to a combustion furnace or gasification reactor is possible without sedimentation of the burnable solid.

In the conventional methods for feeding coal and water to a gasification reactor to gasify the coal, there was a problem that heavy abrasion takes place in pipes in the heater and a feeding pipe connected to the gasification reactor, if at least a part of the water is fed in a form of steam. In order to solve this problem, it might be thought to make inner diameters of pipes in a heater and a feeding pipe large enough to reduce a flow rate of the fluid. However, if the inner diameters are made large enough to suppress abrasion, other problems, in turn, arises that coal subsides on the inner wall of the pipes and further smooth conveying of the coal becomes difficult.

The inventors have made various researches to solve these problems. As a result, the inventors have found that in pumping a mixture comprising a burnable solid and water to a combustion furnace or gasification reactor if a discharge pressure is controlled so as to be in the following relatively high specific range, the flow rate of the mixture may be controlled properly with diameters of the pipes being set in a proper range to thereby feed the mixture to the above-mentioned reactors in a stable manner without abrasion or sedimentation of the burnable solid in the pipes through which the mixture flows.

Thus the present invention provides (1) a method for feeding a mixture comprising a burnable solid and water to a combustion furnace or gasification reactor, comprising heating the mixture with a heater to convert at least a part of the water in the mixture into a form of steam and feeding the whole mixture to a combustion furnace or gasification reactor, wherein the whole mixture is transferred between the heater and the combustion furnace or gasification reactor by a pump, characterized in that a discharge pressure at the pump is higher than an the inner pressure in the combustion furnace or gasification reactor at least by 1.5 MPa and not higher than 22.12 MPa, and that a flow rate of said mixture with at least a part of the water in the mixture being in a form of steam is from 6 to 50 m/s in a pipe within the heater and in a pipe between an outlet of the heater and an inlet of the combustion furnace or gasification reactor.

Preferred embodiments are as follows:

(2) the method according to the above-described (1), wherein a discharge pressure at the pump is higher than the inner pressure of the combustion furnace or gasification reactor by from 3.0 MPa to 15.0 MPa;

(3) the method according to the above-described (1), wherein a discharge pressure at the pump is higher than an inner pressure in the combustion furnace or gasification reactor by from 4.0 MPa to 15.0 MPa;

(4) the method according to any one of the above-described (1)-(3), wherein the above-described flow rate is from 8 to 40 m/s;

(5) the method according to any one of the above-described (1)-(3), wherein the above-described flow rate is from 10 to 40 m/s;

(6) the method according to any one of the above-described (1)-(5), wherein an inner diameter of the pipe in the heater becomes larger gradually along a direction of the flow of the mixture, so that the water is gradually converted into a form of steam;

(7) the method according to any one of the above-described (1)-(5), wherein an inner diameter of the pipe in the heater becomes larger stepwise along a direction of the flow of the mixture, so that the water is converted stepwise into a form of steam;

(8) the method according to any one of the above-described (7), wherein a pressure reducing valve is provided between sections of the pipe with different diameters, so that the water in the mixture is converted into a form of steam with an aid of the pressure reducing valve;

(9) the method according to any one of the above-described (7) or (8), wherein an inner diameter of the pipe in the heater becomes larger in from two to twelve steps;

(10) the method according to any one of the above-described (7) or (8), wherein an inner diameter of the pipe in the heater becomes larger in from four to twelve steps;

(11) the method according to any one of the above-described (7) or (8), wherein an inner diameter of the pipe in the heater becomes larger in from six to twelve steps;

(12) the method according to any one of the above-described (7)-(11), wherein a non-flammable gas is blown in just downstream of a place where an inner diameter of the pipe becomes larger or a place where a pressure reducing valve is provided;

(13) the method according to anyone of the above-described (12), wherein the non-flammable gas is steam, nitrogen, or gaseous carbon dioxide;

(14) the method according to any one of the above-described (1)-(13), wherein substantially all of the water is converted into a form of steam;

(15) the method according to any one of the above-described (1)-(14), wherein heating by the heater is carried out at a temperature of from 150 to 450 degrees C. at a pressure of from 1.5 to 22.12 MPa;

(16)the method according to any one of the above-described (1)-(14), wherein heating by the heater is carried out at a temperature of from 200 to 400 degrees C. at a pressure of from 3.0 to 22.12 MPa;

(17) the method according to any one of the above-described (1)-(14), wherein heating by the heater is carried out at a temperature of from 200 to 365 degrees C. at a pressure of from 4.0 to 20.0 MPa;

(18) the method according to any one of the above-described (1)-(17), wherein heating is carried out with a heating medium at a temperature of from 200 to 600 degrees C.;

(19) the method according to any one of the above-described (1)-(18), wherein a pressure control valve is provided between the outlet of the heater and the combustion furnace or gasification reactor;

(20) the method according to any one of the above-described (1)-(19), wherein a pre-heater is provided upstream of the heater;

(21) the method according to the above-described (20), wherein a pressure reducing valve is provided at the outlet of the pre-heater;

(22) the method according to any one of the above-described (1)-(21), wherein a water content in the mixture comprising a burnable solid and water is from 27 to 80 weight %, relative to the total weight of the mixture;

(23) the method according to any one of the above-described (1)-(21), wherein a water content in the mixture comprising a burnable solid and water is from 30 to 40 weight %, relative to the total weight of the mixture; and

(24) the method according to any one of the above-described (1)-(21), wherein a water content in the mixture comprising a burnable solid and water is from 30 to 35 weight %, relative to the total weight of the mixture.

DESCRIPTION OF THE PREFERRED EMBODIMENTS

Figure 1:
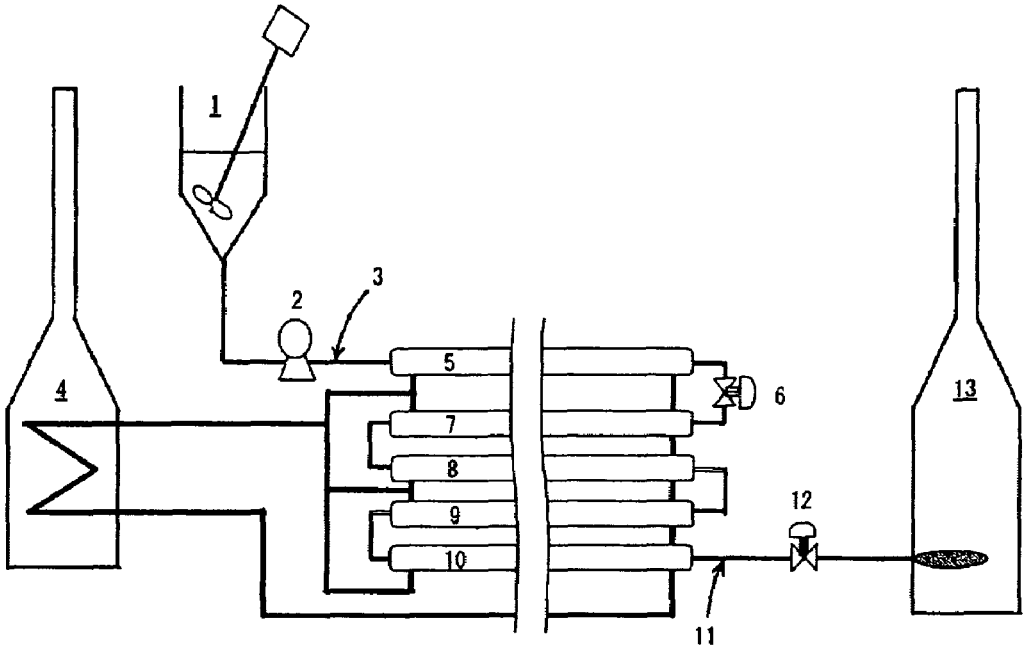
FIG. 1 is a process flow chart of the device used in the Examples.

For the water content of the mixture comprising a burnable solid and water used in the present invention, the upper limit is preferably 80 weight %, more preferably 40 weight %, and even more preferably 35 weight %, and the lower limit is preferably 27 weight %, and more preferably 30 weight %. Meanwhile, for the content of the burnable solid, the upper limit is preferably 73 weight %, and more preferably 70 weight%, and the lower limit is preferably 20 weight %, more preferably 60 weight%, and ever more preferably 65 weight %. If the water content exceeds the aforementioned upper limit and the content of the burnable solid is less than the aforementioned lower limit, the energy to vaporize water is too large for the present method to be economical. If the water content is less than the aforementioned lower limit and the content of the burnable solid exceeds the aforementioned upper limit, the mixture comprising the burnable solid and water is too viscous to be transferred smoothly. A surfactant may be added to facilitate formation of an aqueous slurry of a burnable solid.

The burnable solids subjected to combustion or gasification are not particularly limited to specific kinds. Use may be made of, for instance, coal, coal or petroleum coke, coal or petroleum pitch, or cellulosic solid waste. Coal of various coal ranks may be used, such as bituminous coal, sub-bituminous coal, or brown coal. Coal containing an ash of a high melting point is difficult to use in a conventional method where a coal/water slurry is fed to a gasification reactor. In the present invention, such a limitation caused by melting point of ash is imposed. The burnable solid is preferably pulverized to a desired grain size before used. The grain size is preferably from 25 to 500 meshes, more preferably from 50 to 200 meshes. If the grain size of the coal is too large, the coal particles cause very fast sedimentation in water. The coal is pulverized preferably in a dry state before mixed with water, but it may be also pulverized in a wet state after mixed with water.

The mixture comprising a burnable solid and water is fed by a pump to a combustion furnace or gasification furnace through a heater. As the pump, any known pump may be used, and mention may be made of, for instance, a centrifugal pump, a plunger pump, or a gear pump.

The upper limit of the discharge pressure of the pump in the present invention is 22.12 MPa, which is the saturated steam pressure at the critical temperature of water, 374.15 degrees C. The pressure is preferably higher than a pressure in the combustion furnace or gasification furnace by 15.0 MPa, and more preferably by 10.0 MPa. The lower limit is a pressure higher than a pressure in the combustion furnace or gasification furnace by 1.5 MPa, preferably by 3.0 MPa, and more preferably by 4.0 MPa. If the pressure exceeds the aforesaid upper limit, large costs are needed to make apparatuses pressure-proof and, therefore, the method is uneconomical. If the pressure is lower than the aforementioned lower limit, more water will vaporize than desired and, therefore, the flow rate of the mixture becomes lower than the required flow rate as described below and, therefore, the burnable mixture sometimes cannot be smoothly transferred to the gasification reactor.

As the heater in the present invention, use may be made of any heater that can heat the above-described mixture and convert at least a part of the water in the mixture, preferably substantially all of the water, into a form of steam. For instance, a heating furnace or a heat exchanger may be used. Preferably, a heat exchanger, more preferably a double tube heat exchanger, may be used.

In the present invention, it is needed that the flow rate of the aforementioned mixture in the pipe of the heater and in the pipe between the outlet of the heater and the inlet of the combustion furnace or gasification reactor be in the following range; the upper limit of the flow rate: 50 m/s, preferably 40 m/s, and more preferably 30 m/s; and the lower limit: 6 m/s, preferably 8 m/s, and more preferably 10 m/s. Thereby the mixture may be fed to the combustion furnace or gasification reactor in a stable manner. If the flow rate exceeds-the aforementioned upper limit, the pipes wear out heavily. If the flow rate is lower than the aforementioned lower limit, the pipes easily clog because of the sedimentation of the burnable solid.

The inner diameter of the pipe in the heater through which the mixture comprising a burnable solid and water passes preferably becomes larger gradually, and more preferably stepwise along a direction of the flow of the mixture. Thereby the water in the mixture may be converted into a form of steam gradually or stepwise to control the flow rate of the mixture properly. In an embodiment wherein an inner diameter of the pipe becomes larger stepwise, the inner diameter becomes larger in from 2 to 12 steps, more preferably in from 4 to 12 steps, even more preferably in from 6 to 12 steps. It is also preferred that pressure reducing valves are provided between sections of the pipe with different inner diameters, whereby a desired amount of the water in the mixture may be converted into a form of steam properly. Preferably a non-flammable gas is blown just downstream of a place where an inner diameter of a pipe becomes larger or just downstream of a place where a pressure reducing valve is provided. As the non-flammable gas, steam, nitrogen, or carbon dioxide is preferably used. By blowing the non-flammable gas in, it is possible to prevent the flow rate of the mixture in the pipe from lowering, and to thereby maintain the flow rate of the mixture in the pipes in the desired range described above.

In the heater, the aforementioned mixture is heated to a temperature at which at least a part, preferably substantially all, of the water in the mixture vaporizes and is converted into a form of steam. The upper limit of the heating temperature is preferably 450 degrees C., more preferably 400 degrees C., and particularly preferably 365 degrees C. The lower limit is preferably 150 degrees C., more preferably 200 degrees C., and even more preferably, 250 degrees C. If the temperature exceeds the aforementioned upper limit, a burnable solid, such as coal, causes an intense thermal decomposition and the resulting hydrocarbon substances often cause coking in the pipes, which leads to choke of the pipes in the heater. Below the lower limit, water may not be sufficiently vaporized. The pressure in the pipe in the heater during the heating described above depends on a discharge pressure of the pump and is preferably from 1.5 to 22.12 MPa, more preferably from 3.0 to 22.12 MPa, and even more preferably from 4.0 to 20.0 MPa.

The aforementioned heating is carried out preferably by a heating medium, preferably heating oil or fused salt in a heat exchanger, such as a double tube heat exchanger. A temperature of the heating medium is preferably from 200 to 600 degrees C., more preferably from 250 to 500 degrees C., and particularly preferably from 300 to 450 degrees C. If the temperature exceeds the aforementioned upper limit, a burnable solid, such as coal, causes thermal decomposition and the resulting hydrocarbon substances cause coking, which often leads to the choke of the pipe in the heater. Below the aforementioned lower limit, it is difficult to heat the mixture to the desired temperature described above. A heater for heating the heating medium is not particularly restricted and any heater that can heat the heating medium to the desired temperature described above may be used. Preferably a heat exchanger using a heating medium such as hot steam, hot oils, fused salts or gases may be used.

In the present invention, a pre-heater may be provided to heat the mixture before the mixture is heated in the above-described heater, whereby the temperature at which the mixture is fed to a combustion furnace or gasification reactor may be controlled properly, depending upon an operation temperature of t he combustion furnace or gasification reactor. The upper limit of the pre-heating temperature is preferably 450 degrees C., more preferably 400 degrees C., and even more preferably 365 degrees C. The lower limit is preferably 150 degrees C., more preferably 200 degrees C., and even more preferably 250 degrees C. The pressure in the pre-heating may be similar with the discharge pressure of the pump. The pre-heater aims to heat the mixture to a certain temperature and, therefore, the pressure in a pipe in the pre-heater is preferably equal to or higher than the saturated vapor pressure at the aforementioned desired temperature so as to prevent the water in the mixture from evaporating. In order to keep this pressure, a pressure control valve may preferably be provided at an outlet of the pre-heater.

The mixture comprising a burnable solid and water is heated to the aforementioned desired temperature in the heater, and at least a part, more preferably substantially all, preferably 95 weight % or more, and more preferably 98 weight % or more, of the water is converted into steam. The resulting steam pneumatically conveys the burnable solid and feeds it to the combustion furnace or gasification reactor. The combustion furnace is preferably kept at a temperature of from 1,300 to 2,000 degrees C., and more preferably from 1,300 to 1,700 degrees C., under an atmospheric pressure or slightly pressurized condition to burn the introduced burnable solid. Meanwhile, the gasification reactor is kept at a temperature of from 1,000 to 2,500 degrees C., more preferably from 1,300 to 2,000 degrees C. at a pressure of from 0.5 to 10 MPa, more preferably from 1 to 10 MPa, and even more preferably 2 to 10 MPa, to gasify the introduced burnable solid. The combustion furnace or gasification reactor is preferably provided with a pressure control valve, capable of being fully closed, at the inlet, so that the amount of the mixture to be fed to the furnace may be properly controlled.

The method of the present invention may be applied to any known combustion or gasification methods to burn or gasify a mixture containing a burnable solid and water. As the gasification method, Texaco method and the Dow method may be mentioned.

The present invention will be explained in detail with reference to the following Examples, but shall not be limited thereto.

EXAMPLES

Example 1

The process flow shown in FIG. 1 was used in Example 1, wherein 1 is a tank; 2, a pump; 3, a pipe; 4, a heater for a heating medium; 5, a pre-heater; 6, a pressure control valve; 7, a first heater; 8, a second heater; 9, a third heater; 10, a fourth heater; 11, a pipe; 12, a pressure control valve; and 13, a gasification reactor. As the burnable solid, pulverized coal A, general coal with a grain size of from 50 to 200 meshes, was used. The pulverized coal was mixed with a given amount of water in a slurry maker, not shown, to prepare a mixture of coal and water. The mixture was placed in tank 1 and stirring was continued to prevent sedimentation of the pulverized coal. The coal and water contents and the viscosity of the mixture and the Higher Heating Value, the ash content of the coal, and the melting point of the ash from the coal are as shown in the following Table 1.

TABLE 1

| | |
|---|---|
| Mixture | |
| Coal Content | 50.0 weight % |
| Water Content | 50.0 weight % |
| Viscosity | 4000 cp at 20 deg. C. to 170 cp at 95 deg. C. |
| Coal | |
| Ash Content | 4.3 weight % |
| Higher Heating Value (HHV) | 3210 kcal/kg |
| Melting Point of Ash | 1150 deg. C. |

The above-described mixture of coal and water was pressurized with an aid of pump 2 to 11.76 MPa (120 kg/cm$^2$), and then conveyed to pre-heater 5 through line 3 in a flow amount of 130 kg/hour. The mixture pipe in pre-heater 5 was 6 mm in inner diameter and 80 m in total length. Here, the mixture was pre-heated to 300 degrees C. with a heating medium of 340 degrees C. In a heater for heating medium 4. In order to prevent the water in the mixture from evaporating in pre-heater 5 and also to compensate pressure loss, the pressure in the pump side of the mixture pipe was maintained at a pressure of 10.58 MPa, (108 kg/cm$^2$), which is higher than the saturated vapor pressure of water at 300 degrees C., approximately 8.82 MPa (approximately 90 kg/cm$^2$). The flow rate of the mixture in the pipe of pre-heater 5 was 1.16 m/s.

The mixture pre-heated to 300 degrees C. In pre-heater 5 was transferred to first heater 7 via pressure control valve 6. The mixture pipe of first heater 7 was composed of a pipe of 2 mm in inner diameter×2 m long, a pipe of 3 mm in inner diameter×4 m long, and a pipe of 4 mm in inner diameter×4 m long, the total length, 10 m along a direction of the flow of the mixture. The mixture was heated also in this pipe with a heating medium of 340 degrees C. In first heater 7, a part of the water of the mixture evaporated. The flow rate of the mixture in the pipe of first heater 7 was 11.5 m/s at a pressure of 9.18 MPa (93.7 kg/cm$^2$) at the inlet, with the inner diameter being 2 mm, and 27.95 m/s at the outlet, with the inner diameter being 4 mm. The temperature at the outlet was 268 degrees C. and the pressure at the outlet was 5.24 MPa (53.5 kg/cm$^2$).

The mixture which left first heater 7 was conveyed to second heater 8. A mixture pipe in second heater 8 was 6 mm in inner diameter and 10 m in total length. Here the mixture was again heated with a heating medium of 340 degrees C. Further, a part of the water in the mixture vaporized due to the adiabatic expansion in second heater 8. The flow rate of the mixture in the pipe of second heater 8 was 12.55 m/s at the inlet and 29.25 m/s at the outlet. At the outlet the temperature was 255 degrees C. and the pressure was 4.19 MPa (42.8 kg/cm$^2$).

The mixture which left second heater 8 was then conveyed to third heater 9. A mixture pipe in third heater 9 was 8 mm in inner diameter and 10 m in total length. Here the mixture was again heated with a heating medium of 340 degrees C. Further, a part of the water in the mixture vaporized due to the adiabatic expansion in third heater 9. The flow rate of the mixture in the pipe of third heater 9 was 16.45 m/s at the inlet and 33.02 m/s at the outlet. At the outlet the temperature was 245 degrees C. and the pressure was 2.8 MPa (28.6 kg/cm$^2$).

The mixture which left third heater 9 was conveyed to fourth heater 10. The mixture pipe in fourth heater 10 was 12 mm in inner diameter and 30 m in total length. Here the mixture was again heated with a heating medium of 340 degrees C. Further, a part of the water in the mixture vaporized due to the adiabatic expansion in fourth heater 10 and, after all, substantially all of the water in the mixture introduced into the heaters was converted into steam. The flow rate of the mixture in the pipe of fourth heater 10 was 11.3 m/s at the inlet and 35.76 m/s at the outlet. At the outlet the temperature was 300 degrees C. and the pressure was 1.96 MPa (20 kg/cm$^2$).

The mixture thus heated was introduced via line 11 and control valve 12 to gasification reactor 13 where the pressure was maintained at 1.96 MPa (20 kg/cm$^2$). In the gasification reactor, the pulverized coal was gasified according to a known method. The flow rate in line 11 was almost equal to that at the outlet of fourth heater 10.

Figure 2:
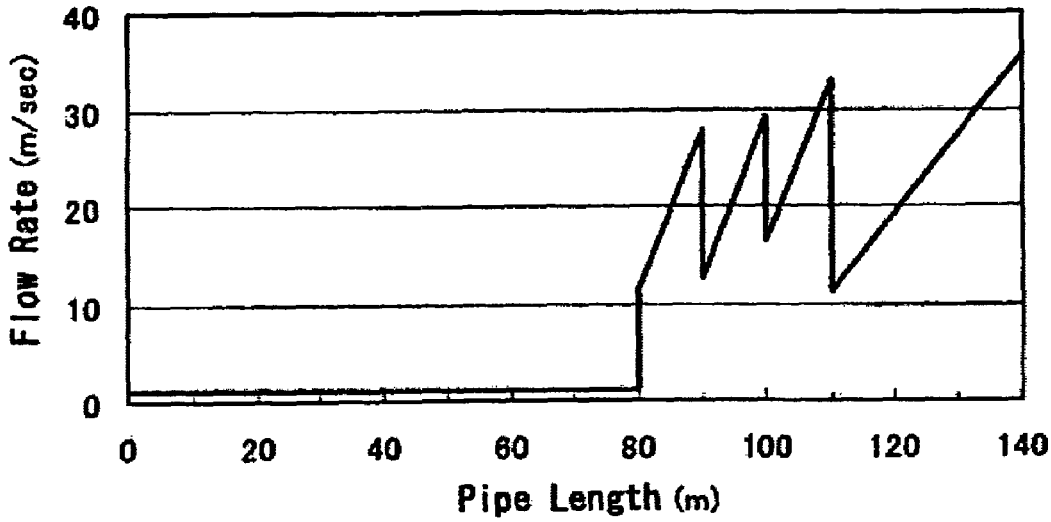
FIG. 2 is a graph to show a profile of the flow rate in the pipe between the outlet of the pump and the inlet of the gasification reactor in the Example 1.
Figure 3:
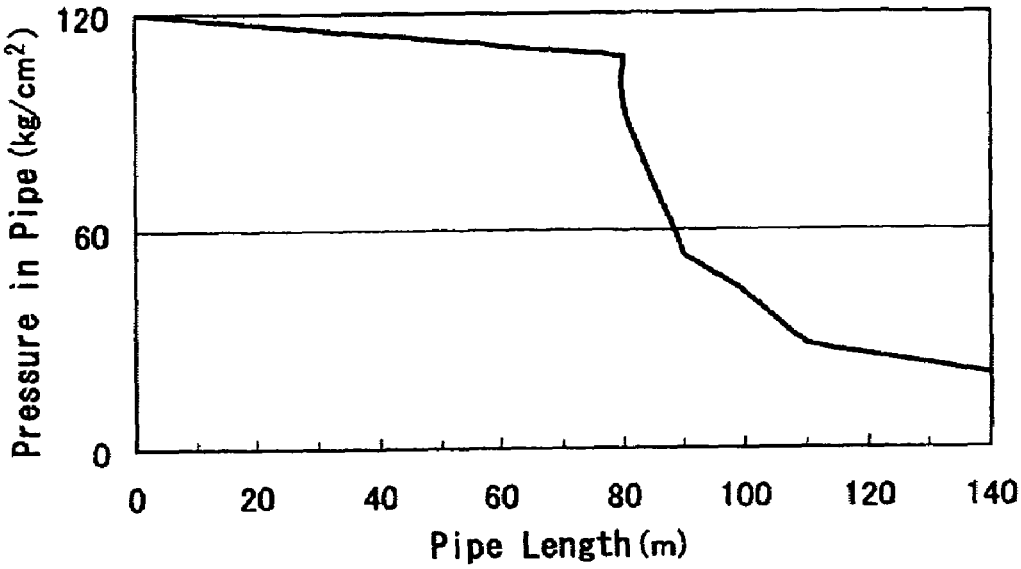
FIG. 3 is a graph to show a profile of the pressure in the pipe between the outlet of the pump and the inlet of the gasification reactor in Example 1.

FIGS. 2 and 3 show changes in flow rates and pressures between the outlet of pump 2 and gasification reactor 13. The flow rate of the mixture was calculated from the pressures and temperatures in the pipes of each heater.

The above steps were continued for 50 hours, during which stable operations could be attained without sedimentation of the pulverized coal. After the operations, the pipe connecting to the gasification reactor and the inlet and the outlet of the control valve 12, where the flow rate through the piping became fastest, were inspected visually to find almost no abrasion on each inner wall.

Example 2

In Example 2, the same process flow as in Example 1, shown in FIG. 1, was used. The viscosity of the mixture used in Example 2 was different from that of the mixture used in Example 1 since the type of the pulverized coal was different as shown below. Accordingly, lengths of the mixture pipes in the pre-heater and the heaters were changed so that stable operations would be secured over a long time. As the burnable solid, pulverized coal B, general coal with a grain size of from 50 to 200 meshes, was used instead of the pulverized coal A to prepare a mixture of coal and water according to the same procedures as Example 1. The coal and water contents and the viscosity of the mixture and the higher heating value, the ash content, and the melting point of the ash of the coal are as shown in the following. Table. 2.

TABLE 2

| | |
|---|---|
| Mixture | |
| Coal Content | 50.0 weight % |
| Water Content | 50.0 weight % |
| Viscosity | 400 cp at 20 deg. C. to 70 cp at 95 deg. C. |
| Coal | |
| Ash Content | 9.5 weight % |
| Higher Heating Value (HHV) | 7090 kcal/kg |
| Melting Point of the Ash | 1450 deg. C. |

A mixture of the aforesaid coal and water was pressurized to 9.87 MPa (100.6 kg/cm$^2$) with pump 2 and then was conveyed to pre-heater 5 via line 3 in a flow amount of 140 kg/hour. A mixture pipe in pre-heater 5 was 6 mm in inner diameter and 73 m in total length. In this pipe, the mixture was pre-heated to 300 degrees C. with a heating medium heated to 310 degrees C. in a heater for heating medium 4. In order to prevent water in the mixture from vaporizing in pre-heater 5 and to compensate pressure loss, the pressure in the pump side of the mixture pipe was maintained at 9.25 MPa (94.3 kg/cm$^2$), which pressure was higher than the saturated vapor pressure of water at 300 degrees C., approximately 8.82 MPa (approximately 90 kg/cm$^2$). The flow rate of the mixture in the pipe of pre-heater 5 was 1.3 m/s.

The mixture pre-heated to 300 degrees C. in pre-heater 5 was conveyed to first heater 7 via pressure control valve 6. The mixture pipe of first heater 7 was composed of a pipe of 2 mm in inner diameter×3 m long, a pipe of 3 mm in inner diameter×2 m long, and a pipe of 4 mm in inner diameter×2 m long joined in this order toward the gasification reactor along with the direction of the flow, and the total length was 7 m. The mixture was again heated in this pipe with a heating medium of 310 degrees C. In first heater 7, a part of the water of the mixture vaporized. The flow rate of the mixture in first heater 7 was 13.4 m/s at a pressure of 8.97 MPa (91.5 kg/cm$^2$) at the inlet of the pipe, with the inner diameter of 2 mm, and 23.7 m/s at the outlet of the pipe, with the inner diameter of 4 mm. The temperature at the outlet was 252 degrees C. and the pressure at the outlet was 4.03 MPa (41.1 kg/cm$^2$).

The mixture which left first heater 7 was conveyed to second heater 8. The mixture pipe of second heater 8 was 6 mm in inner diameter and 11.5 m in total length. The mixture was heated also here with a heating medium of 310 degrees C. A part of the water in the mixture vaporized further due to the adiabatic expansion in second heater 8. The flow rate of the mixture in second heater 8 was 10.8 m/s at the inlet of the pipe and 19.9 m/s at the outlet. At the outlet the temperature was 245 degrees C. and the pressure was 3.55 MPa (36.2 kg/cm$^2$).

The mixture which left second heater 8 was conveyed to third heater 9. The mixture pipe of third heater 9 was 8 mm in inner diameter and 16.5 m in total length. The mixture was heated also here with a heating medium of 310 degrees C. A part of the water in the mixture vaporized further due to the adiabatic expansion in third heater 9. The flow rate of the mixture in third heater 9 was 11.4 m/s at the inlet and 25.8 m/s at the outlet. At the outlet the temperature was 227 degrees C. and the pressure was 2.54 MPa (25.9 kg/cm$^2$).

The mixture which left second heater 9 was conveyed to fourth heater 10. The mixture pipe of fourth heater 10 was 12 mm in inner diameter and 19 m in total length. The mixture was heated also here with a heating medium of 310 degrees C. A part of the water in the mixture vaporized further due to the adiabatic expansion in fourth heater 10 and, after all, substantially all of the water in the mixture introduced into the heaters was converted into steam. The flow rate of the mixture in fourth heater 10 was 11.7 m/s at the inlet and 19.9 m/s at the outlet. At the outlet the temperature was 244 degrees C. and the pressure was 1.96 MPa (20 kg/cm$^2$).

The mixture thus heated was introduced via line 11 and control valve 12 to gasification reactor 13 maintained at a pressure of 1.96 MPa (20 kg/cm$^2$). In the gasification reactor, the pulverized coal was gasified according to a known method. The flow rate of the mixture in line 11 was almost equal to that at the outlet of fourth heater 10.

Figure 4:
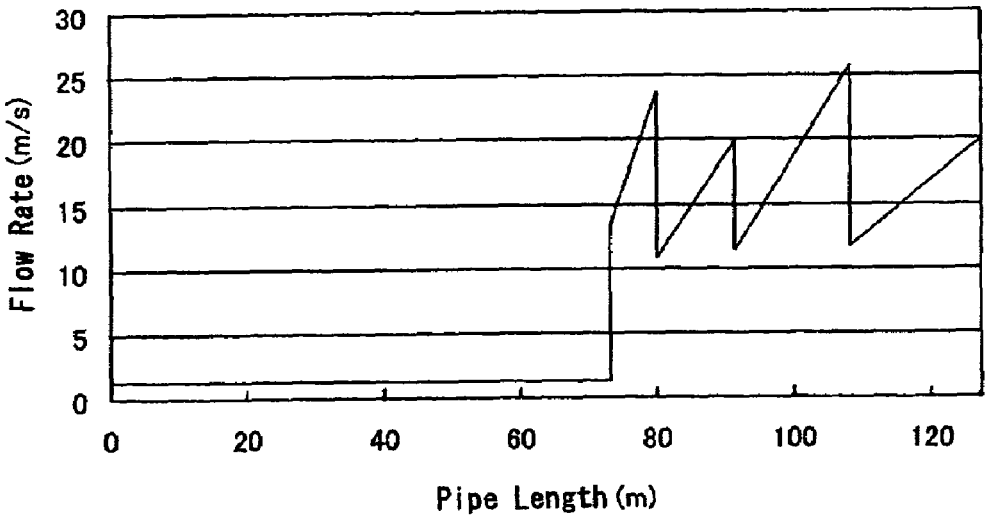
FIG. 4 is a graph to show a profile of the flow rate in the pipe between the outlet of the pump and the inlet of the gasification reactor in Example 2.
Figure 5:
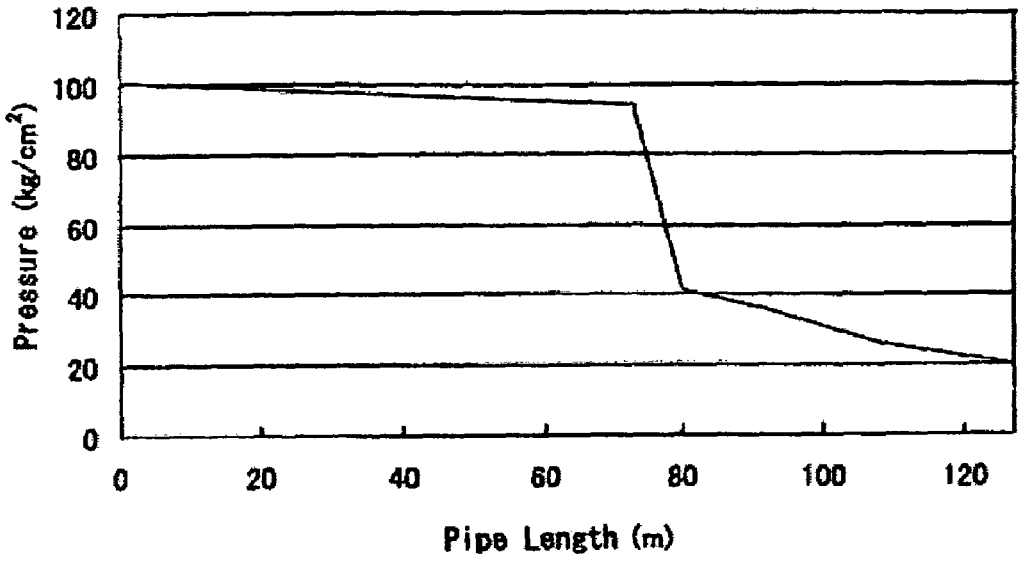
FIG. 5 is a graph to show a profile of the flow rate in the pipe between the outlet of the pump and the inlet of the gasification reactor in Example 2.

Profiles of the flow rates and pressures of the mixture from the outlet of pump 2 to gasification reactor 13 described above are shown in FIGS. 4 and 5. The flow rate of the mixture was calculated from the pressures and temperatures in the pipes of each heater.

The aforementioned steps were continued for 50 hours, during which stable operations were attained without sedimentation of the pulverized coal. After the operations, the pipe connecting to the gasification reactor and the inlet and the outlet of the control valve 12, where the flow rate through the pipes became fastest, were inspected visually to find almost no abrasion on each inner wall as in Example 1.

INDUSTRIAL APPLICABILITY

The present invention provides a method for feeding a mixture comprising a burnable solid and water to a combustion furnace or gasification reactor wherein at least a part of the water in the mixture is converted into a form of steam, and wherein almost no abrasion takes place in piping and stable feeding to a combustion furnace or gasification reactor is possible without sedimentation of the burnable solid.

The invention claimed is:

1. A method for feeding a mixture comprising a burnable solid and water to a combustion furnace or gasification reactor, comprising:

heating the mixture with a heater to convert at least a part of the water in the mixture into a form of steam; and feeding the whole mixture to a combustion furnace or gasification reactor, wherein the whole mixture is transferred between an inlet of the heater and the combustion furnace or gasification reactor by a pump, a discharge pressure at the pump is higher than an inner pressure in the combustion furnace or gasification reactor at least by 1.5 MPa and not higher than 22.12 MPa, a flow rate of said mixture with at least a part of the water being in a form of steam is from 6 to 50 m/s in a pipe in the heater and in a pipe between an outlet of the heater and an inlet of the combustion furnace or gasification reactor, and an inner diameter of the pipe in the heater becomes larger gradually or stepwise along a direction of the flow of the mixture, so that the water in the mixture is gradually or stepwise converted into a form of steam.

2. The method according to claim 1, wherein a discharge pressure at the pump is higher than an inner pressure of the combustion furnace or gasification reactor by from 3.0 MPa to 15.0 MPa.

3. The method according to claim 1, wherein a discharge pressure at the pump is higher than an inner pressure in the combustion furnace or gasification reactor by from 4.0 MPa to 15.0 MPa.

4. The method according to claim 1, wherein said flow rate is from 8 to 40 m/s.

5. The method according to claim 1, wherein said flow rate is from 10 to 40 m/s.

6. The method according to claim 1, wherein an inner diameter of the pipe in the heater becomes larger gradually along a direction of the flow of the mixture, so that the water in the mixture is gradually converted into a form of steam.

7. The method according to claim 1, wherein an inner diameter of the pipe in the heater becomes larger stepwise along a direction of the flow of the mixture, so that the water in the mixture is stepwise converted into a form of steam.

8. The method according to claim 7, wherein a pressure reducing valve is provided between sections of the pipe with different diameters, so that the water in the mixture is converted into a form of steam with an aid of the pressure reducing valve.

9. The method according to claim 7, wherein an inner diameter of the pipe in the heater becomes larger in from 2 to 12 steps.

10. The method according to claim 7, wherein an inner diameter of the pipe in the heater becomes larger in from 4 to 12 steps.

11. The method according to claim 7, wherein an inner diameter of the pipe in the heater becomes larger in from 6 to 12 steps.

12. The method according to claim 7, said non-flammable gas is blown in just downstream of a place where the inner diameter of the pipe becomes larger.

13. The method according to claim 12, wherein said non-flammable gas is steam, nitrogen, or carbon dioxide.

14. The method according to claim 1, wherein substantially all of the water is converted into a form of steam.

15. The method according to claim 1, wherein the heating by the heater is carried out at a temperature of from 150 to 450 degrees C at a pressure of from 1.5 to 22.12 MPa.

16. The method according to claim 1, wherein the heating by the heater is carried out at a temperature of from 200 to 400 degrees C at a pressure of from 3.0 to 22.12 MPa.

17. The method according to claim 1, wherein the heating by the heater is carried out at a temperature of from 200 to 365 degrees C at a pressure of from 4.0 to 20.0 MPa.

18. The method according to claim 1, wherein the heating is carried out with a heating medium of a temperature of from 200 to 600 degrees C.

19. The method according to claim 1, wherein a pressure control valve is provided between the outlet of the heater and the inlet of the combustion furnace or gasification reactor.

20. The method according to claim 1, wherein a pre-heater is provided upstream of the heater.

21. The method according to claim 20, wherein a pressure reducing valve is provided at the outlet of the pre-heater.

22. The method according to claim 1, wherein a water content in the mixture comprising a burnable solid and water is from 27 to 80 weight %, relative to the total weight of the mixture.

23. The method according to claim 1, wherein a water content in the mixture comprising a burnable solid and water is from 30 to 40 weight %, relative to the total weight of the mixture.

24. The method according to claim 1, wherein a water content in the mixture comprising a burnable solid and water is from 30 to 35 weight %, relative to the total weight of the mixture.

* * * * *